US005165353A

United States Patent [19]

Freermann

[11] Patent Number: 5,165,353

[45] Date of Patent: Nov. 24, 1992

[54] SYSTEM FOR SELVEDGING PILE-TYPE TEXTILE

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 769,024

[22] Filed: Sep. 30, 1991

[30] Foreign Application Priority Data

Dec. 1, 1990 [DE] Fed. Rep. of Germany ... 9016341[U]

[51] Int. Cl.[5] ..... D05B 35/02; D05B 35/10

[52] U.S. Cl. ..... 112/147; 112/153

[58] Field of Search ..... 112/141, 143, 147, 153, 112/142, 262.3

[56] References Cited

U.S. PATENT DOCUMENTS

| | | | |
|---|---|---|---|
| 4,448,138 | 5/1984 | Freermann | 112/147 |
| 4,450,780 | 5/1984 | Freermann | 112/153 X |
| 4,509,440 | 4/1985 | Freermann | 112/153 |
| 4,548,146 | 10/1985 | Okada | 112/141 X |
| 4,570,557 | 2/1986 | Freermann | 112/147 |
| 4,589,361 | 5/1986 | Starnes et al. | 112/153 X |
| 4,615,287 | 10/1986 | Henze et al. | 112/153 X |
| 4,648,336 | 3/1987 | Ragnebring | 112/147 |
| 4,957,052 | 9/1990 | Sotome et al. | 112/147 |

FOREIGN PATENT DOCUMENTS

| | | | |
|---|---|---|---|
| 3249642 | 12/1985 | Fed. Rep. of Germany . | |
| 2229199 | 9/1990 | United Kingdom | 112/147 |

*Primary Examiner*—Werner H. Schroeder
*Assistant Examiner*—Paul C. Lewis
*Attorney, Agent, or Firm*—Herbert Dubno

[57] ABSTRACT

A piece of pile-type textile goods having a longitudinal pile-free edge strip of predetermined width is selvedged by moving the goods longitudinally in a transport direction sequentially through four folding stations and then through a stitching station. In the first folding station the outer two-thirds of the edge strip are folded up into a vertical position while the inner third of the edge strip is maintained flat and horizontal so that the edge strip is basically of L-section. Then in the second folding station the outer third of the edge strip is folded inward to a horizontal position while maintaining the inner third flat and horizontal and the middle third upright so that the edge strip is basically of C-section. In the third folding station the outer third of the edge strip is folded down to a vertical position next to and continuous with the middle third while the inner third is maintained flat and horizontal and the middle third upright. In the fourth folding station the outer and middle thirds of the edge strip are folded together down to a horizonal position atop the inner third while maintaining the inner third flat and horizontal. In the stitching station a sewing machine stitches vertically through the inner, middle, and outer thirds of the edge strip to stabilize the triple-folded edge strip.

5 Claims, 7 Drawing Sheets

TRIMMER
STATION A
STATION B
STATION C
STATION D
1
2
2a
2b
2c
3
4
4'
4''
5
6
7
8
9
11
12
13
16
22
VIII
IX
X
XIII 5
15
3
4'
11
12
14'
W
13
14
6
1

7
3
5
15
4
12
14'
W
13
14
6
11
1

8
10'
4"
11
12
15
13
14
10"
6
1

SYSTEM FOR SELVEDGING PILE-TYPE TEXTILE

FIELD OF THE INVENTION

The present invention relates to a system for finishing the edge of a pile-type fabric. More particularly this invention concerns edge seaming or selvedging of terry fabric.

BACKGROUND OF THE INVENTION

In the manufacture of towels and the like from pile-type fabric the starting goods are generally a continuous web of the fabric having edge regions that are devoid of pile, and even having crosswise pile free strips. To form a neat selvedge it is necessary to trim and fold over these edge regions, thereby forming a neat selvedge so that the finished product does not ravel.

As described in my German patent 3,249,642 this is done in a machine comprising a conveyor or transport device that moves the goods longitudinally in a transport direction sequentially along a path through a folding station and then through a stitching station. The conveyor typically comprises driven rollers that maintain the goods fairly flat and taut as they are pulled through the stations at each edge of the goods. In each of the folding stations the edge is folded over by being passed through a spiral-type folder having a pair of coextensive spiral tongues defining a spiral slot through which the edge moves. In the cutting station the folded-over edge is stitched vertically through to stabilize it and form the selvedge.

In this known system it is fairly difficult to maintain a set spacing between the finished selvedge and the edge of the pile region. Any substantial variation makes the portion of the goods a reject. In addition when workpiece thickness changes the folding device, which has a throat of medium width, frequently is too tight or too wide, so that further inaccuracies result or the workpiece jams or folds at the selvedge.

OBJECTS OF THE INVENTION

It is therefore an object of the present invention to provide an improved system for selvedging a pile-type textile workpiece.

Another object is the provision of such an improved system for selvedging a pile-type textile workpiece which overcomes the above-given disadvantages, that is which produces a folded-over and stitched selvedge that is accurately spaced on the goods and that is produced with thin and thick workpieces.

SUMMARY OF THE INVENTION

According to the invention a piece of pile-type textile goods having a longitudinal pile-free edge strip of predetermined width is selvedged by moving the goods longitudinally in a transport direction sequentially through first, second, third, and fourth folding stations and then through a stitching station. In the first folding station the outer two-thirds of the edge strip are folded up into a vertical position while the inner third of the edge strip is maintained flat and horizontal so that the edge strip is basically of L-section. Then in the second folding station the outer third of the edge strip is folded inward to a horizontal position while maintaining the inner third flat and horizontal and the middle third upright so that the edge strip is basically of C-section. In the third folding station the outer third of the edge strip is folded down to a vertical position next to and continuous with the middle third while the inner third is maintained flat and horizontal and the middle third upright. In the fourth folding station the outer and middle thirds of the edge strip are folded together down to a horizonal position atop the inner third while maintaining the inner third flat and horizontal. In the stitching station a sewing machine stitches vertically through the inner, middle, and outer thirds of the edge strip to stabilize the triple-folded edge strip.

Thus with this arrangement the sequential folding of the individual substrips of the pile-free edge strip makes it possible to deal with virtually any fabric thickness. In addition a guide is provided which extends through all of the folding stations and that has an edge that rides against the outer edge of the pile zone, that is at the boundary between the pile-free and pile zones, to keep the workpiece perfectly in line. This ensures that the selvedge will be very accurately formed in the pile-free edge strip.

Top ensure even more perfect selvedging, upstream of the first station the edge strip is trimmed to a predetermined transverse dimension.

The apparatus according to this invention has a horizontally extending table extending past all the stations and supporting the goods in all of the stations and a lower guide bar on the table having a straight longitudinally extending edge that rides against the boundary between the pile-free and the pile zone. A wedge shoe in the first station angles upward from the guide bar so as to lift the outer two thirds of the edge strip. In the second station a deflector projects laterally at an angle from the shoe and engages the outer third of the edge strip. In the third and fourth stations there is a pair of holding tongues including a lower tongue extending horizontally above only the inner third of the edge strip and an upper tongue having an upright section in the third station and a horizontal section in the fourth station and engaging the outer two thirds in both stations. The two tongues are superposed and spaced in the fourth station. These tongues have widths equal generally to one third of the width of the edge strip.

The guide of this invention includes a plurality of longitudinally spaced guide blocks engaging the pile-free edge zone between the first and fourth folding stations and a spring urging the blocks toward the pile zone.

BRIEF DESCRIPTION OF THE DRAWING

The above and other objects, features, and advantages will become more readily apparent from the following, reference being made to the accompanying drawing in which.

Figure 14:
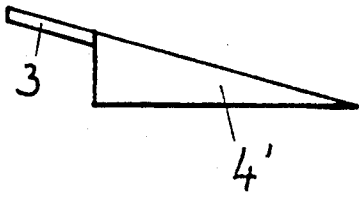
FIG. 14 is a side view of a detail of this invention.
Figure 15:
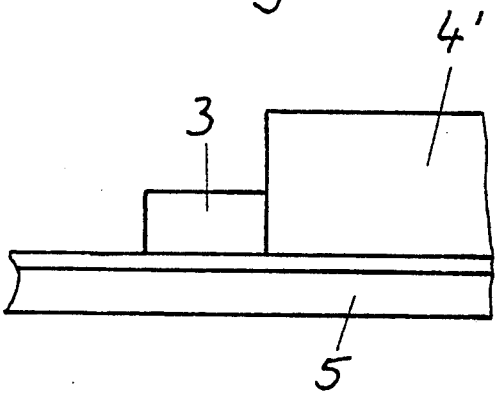

FIC. 15 is a top view of the detail of FIG. 14; and

Figure 16:
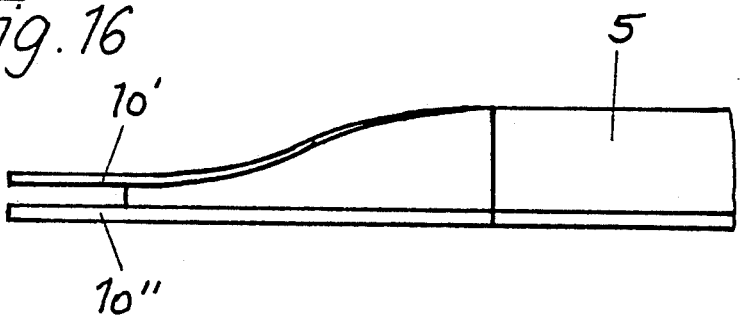

FIG. 16 is a side view of another detail of the invention.

SPECIFIC DESCRIPTION

Figure 9:
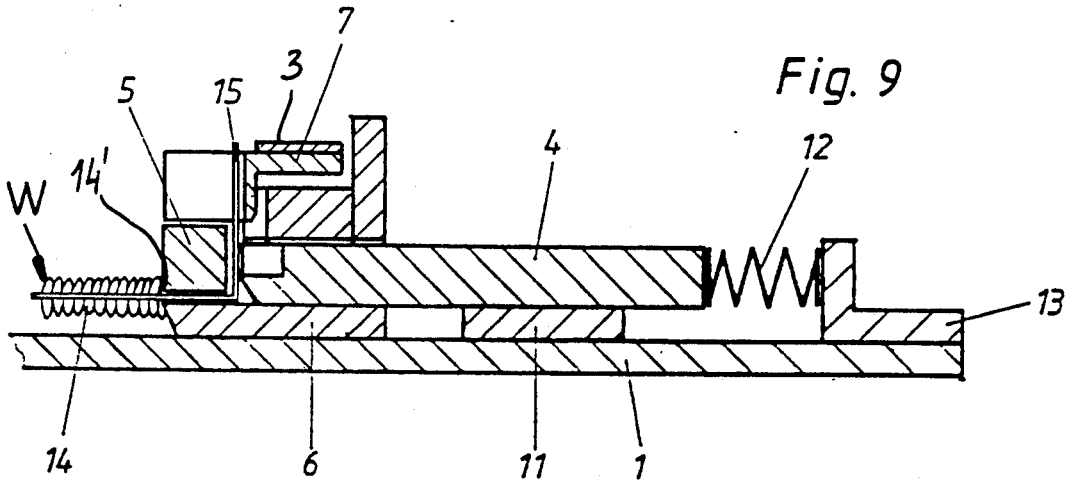
Figure 10:
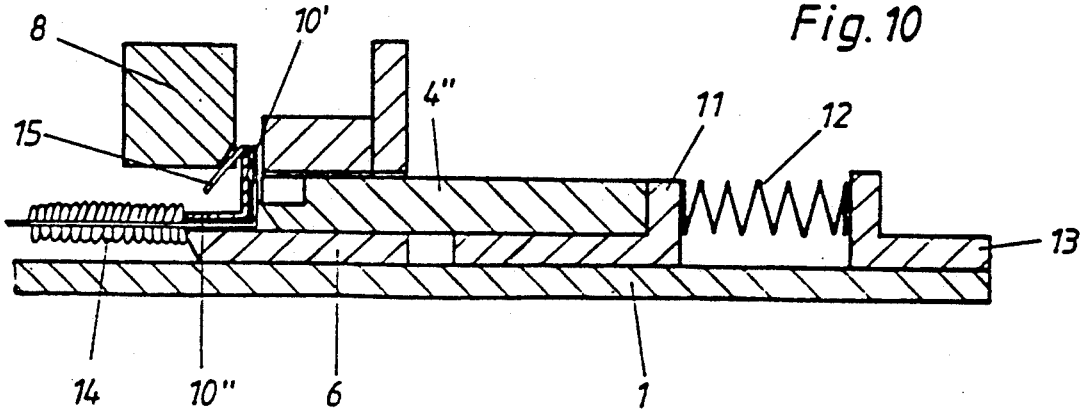
Figure 11:
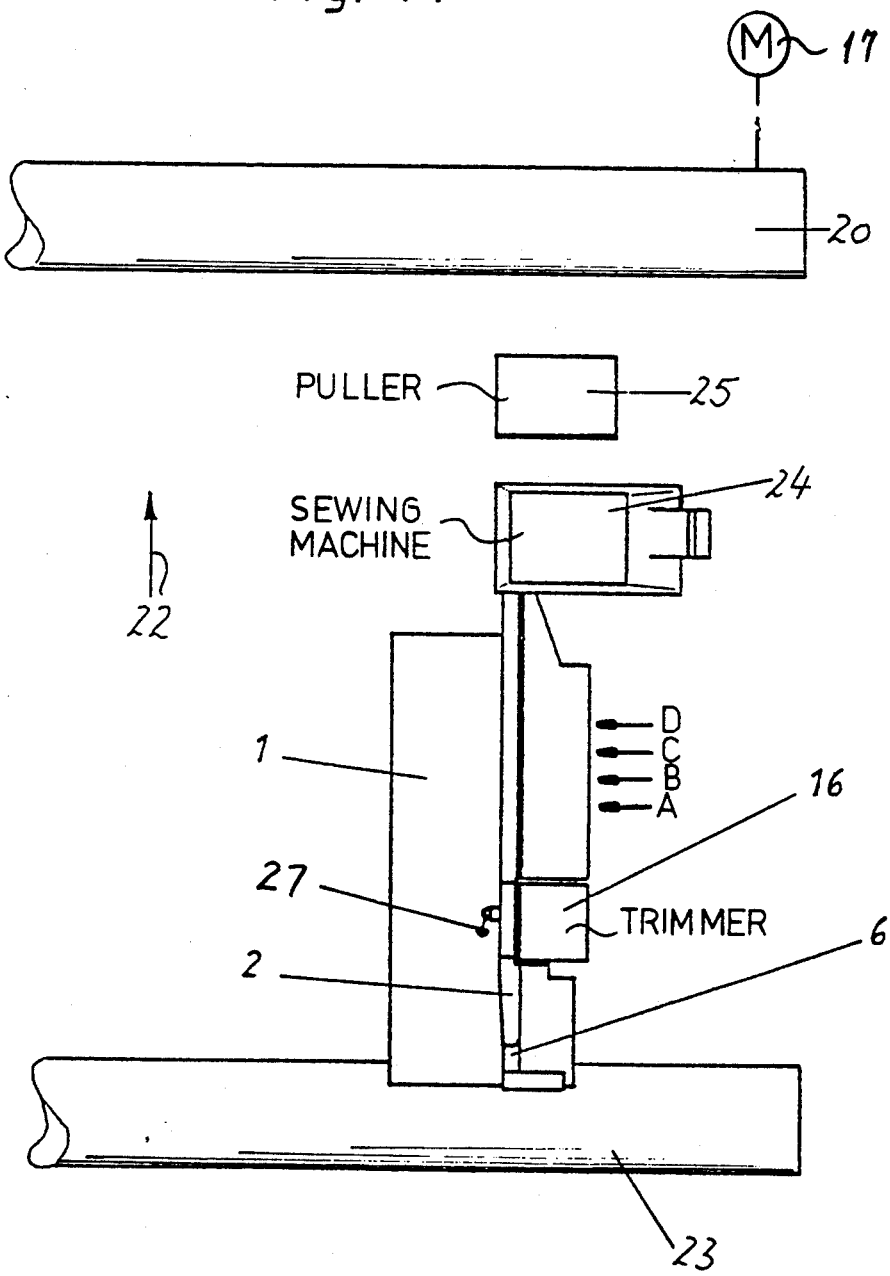
FIG. 11 is a top view of the apparatus.
Figure 12:
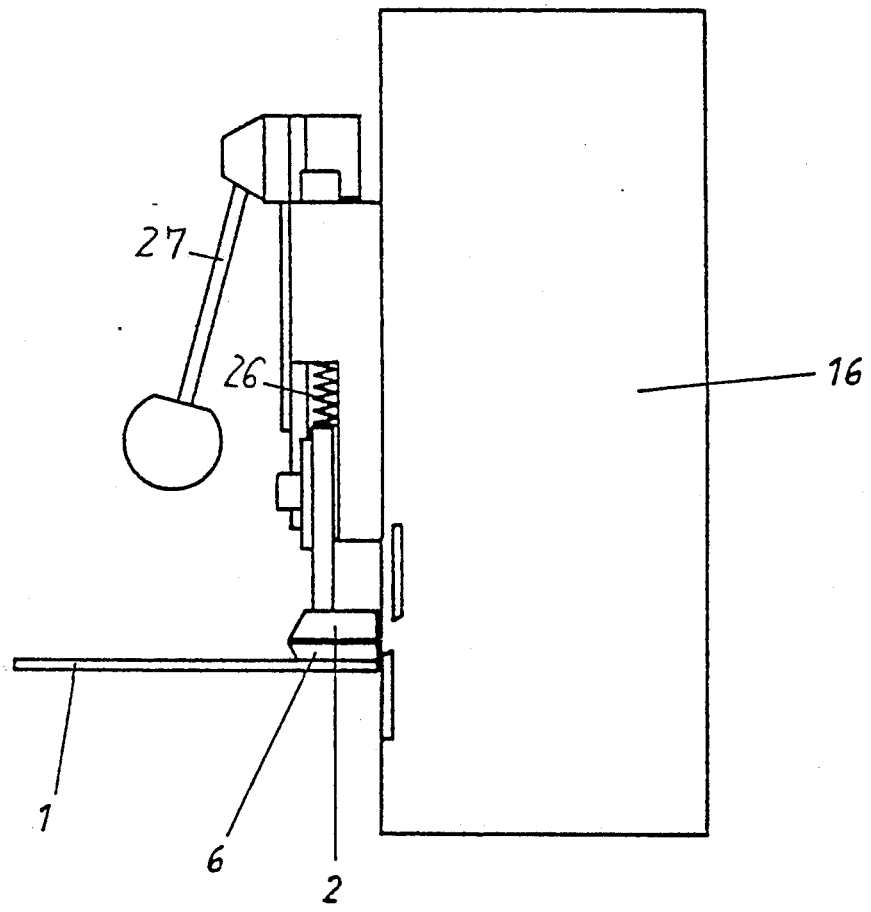
FIG. 12 is an end view of a detail of the structure of FIG. 11.
Figure 13:
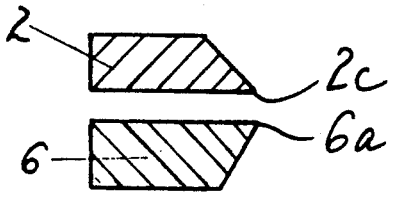
FIG. 13 is a section taken along line XIII—XIII of FIG. 2.

As seen in FIGS. 1 through 10 a textile workpiece web W according to this invention has a central pile region 14 and on each side (only one shown) a pile-free edge region 15 here at least some 21 mm wide. FIG. 11 shows an idler infeed roller 23 over which the workpiece W, which is not illustrated here for clarity of view, is passed and from which it is pulled by an outfeed roller 20 driven by a motor 17 to advance the workpiece W in a horizontal travel direction 22. Each edge of the workpiece W is pulled over a treatment table 1 and then through a sewing machine 24 and a puller 25, the latter being normally formed of two pinch rollers. The upstream end of the table 1 is provided as seen in FIGS. 12 and 13 with a lower guide bar 6 and an upper holddown and alignment shoe 2, the latter vertically positionable by a lever 27 and normally urged downward by a spring 26. The conveyor system formed by the rollers 20 and 23 and the puller 25 aligns the fabric workpiece W so that the edge 14' of the pile region 14 runs along the vertically aligned longitudinal edges of the bar 6 and shoe 2 with the pile-free region 15 extending coplanar with the rest of the workpiece W off between these two elements 2 and 6.

A trimmer 16 is provided to trim the edge region 15 to exactly 21 mm wide. See my copending U.S. patent application Ser. No. 07/706,593 for details on how this trimmer 16 and the associated structure can work to align itself properly relative to the pile edge 14'. On the table 1 upstream of the sewing station constituted by the machine 24 the edge region 15 is therefore first trimmed, then double folded over in the manner described below in a sequence of steps associated with folding stations A, B, C, and D, and finally stitched through at the machine 24.

As seen in FIGS. 3 through 10, the main lower guide bar 6 is fixed on the table 1 and extends through all of the folding stations A through D, with its straight and continuous outer edge 6*a* resting against the outer edge 14' of the pile zone 14. The apparatus may be provided with means to maintain the workpiece W taut and wrinkle free between its pile-free edge zones 15 or it may be left wrinkled or folded here, since what happens in the middle of the workpiece W is not relevant to the invention.

Figure 1:
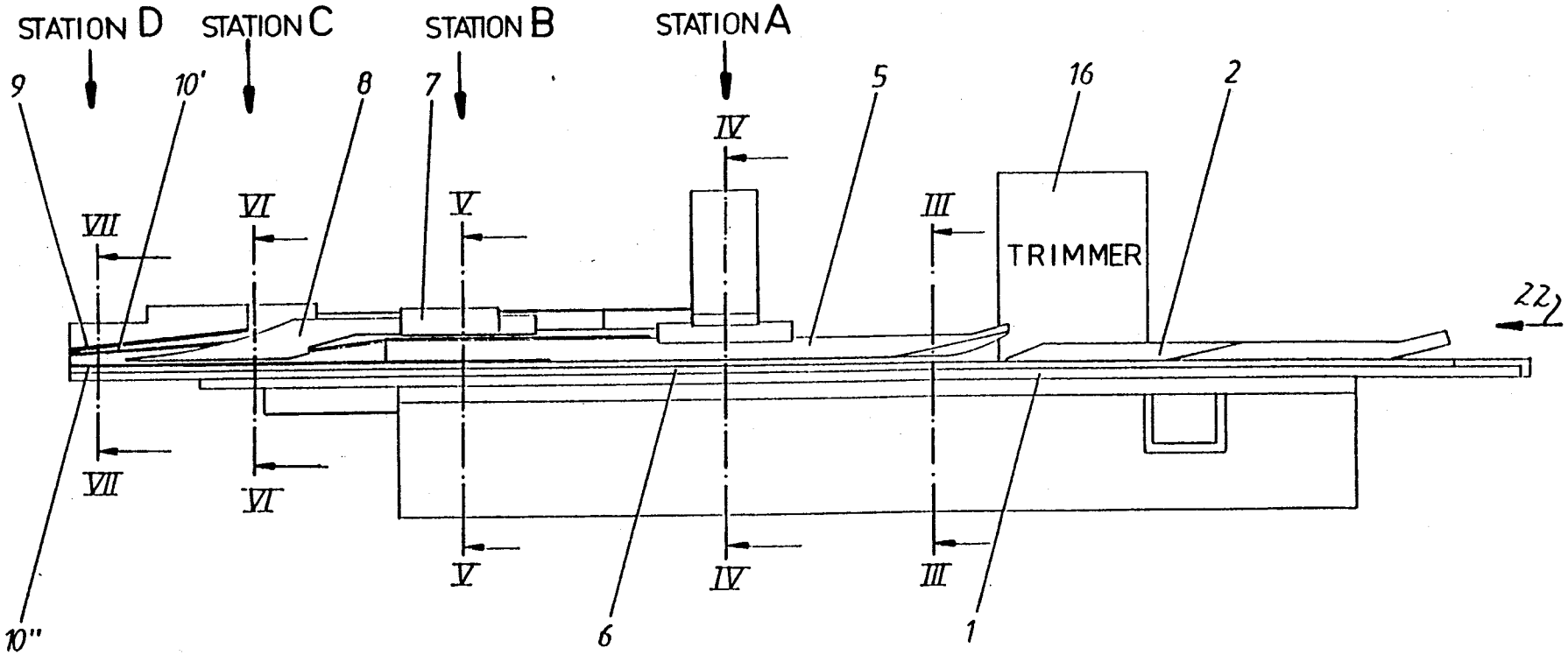
FIG. 1 is a small-scale side view of the apparatus of this invention.
Figure 2:
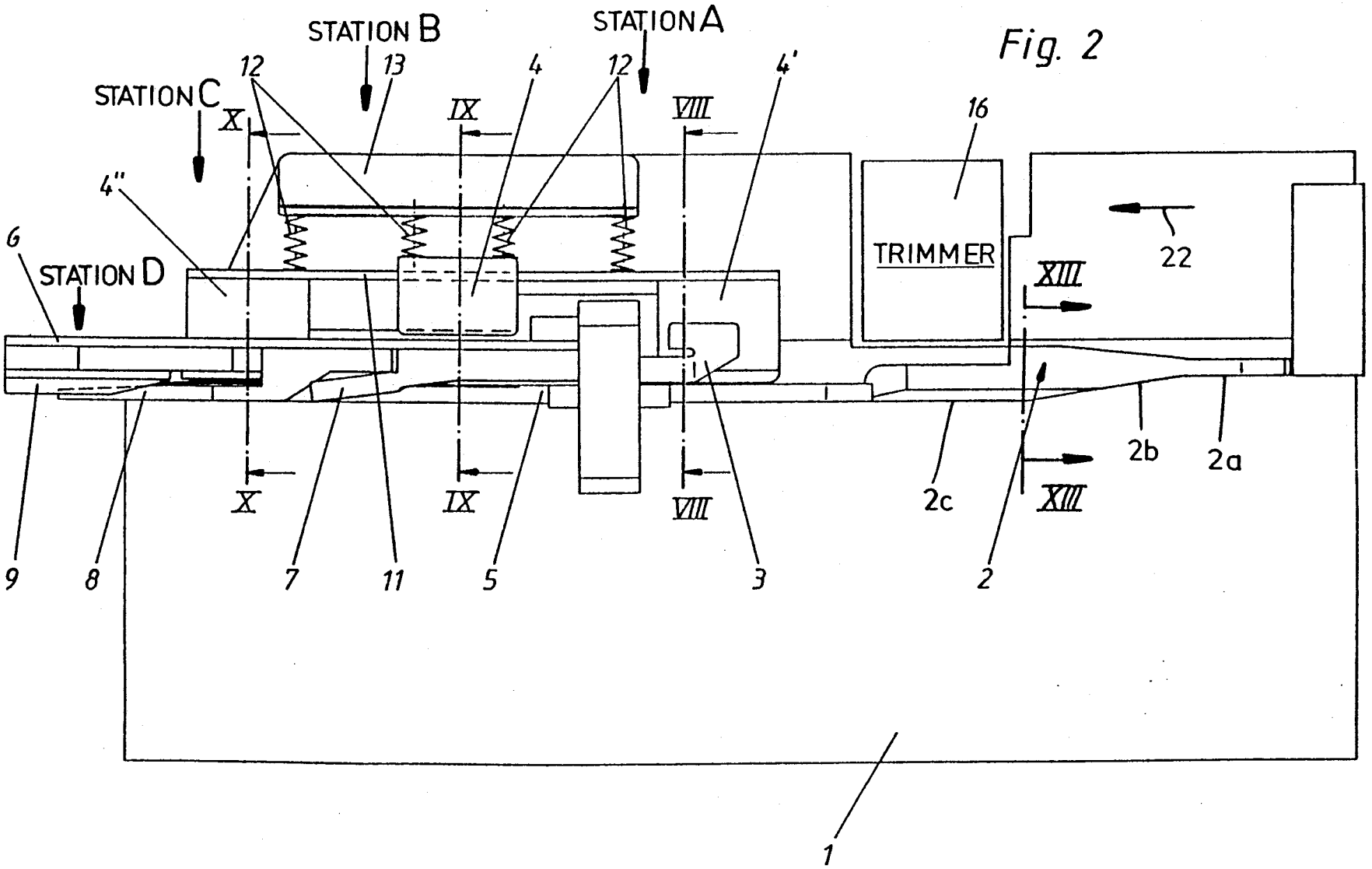
FIG. 2 is a top view of the apparatus.
Figure 3:
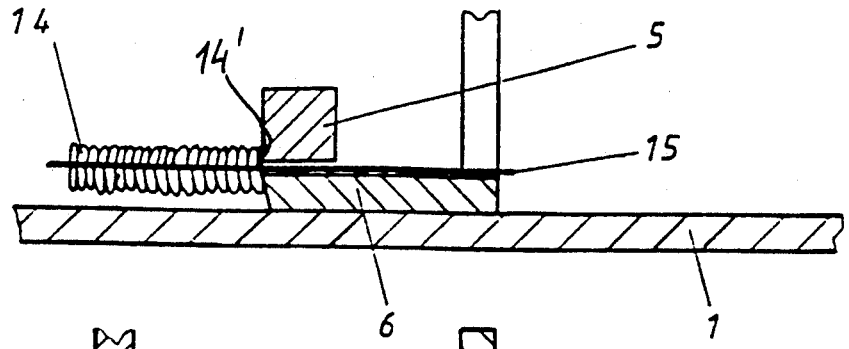
FIGS. 3, 4, 5, 6, and 7 are sections taken along respective lines III—III, IV—IV, V—V, VI—VI, and VII—VII of FIG. 1.

Upstream of station A the entire pile-free region 15 lies on the bar 6 as seen in FIG. 3 but downstream therefrom only the inner third of the strip 15, that is the third of the strip 15 closest to the pile zone 14, lies horizontally on the bar 6. The outer edge 6*a* of the bar 6 engaging the zone edge 14' is beveled back away from it to meet it generally in line contact, ensuring exact positioning of the workpiece W. Transverse stretchers may be provided to keep the outer edge 14' of the pile zone 14 in snug contact with the edges of the bars 6. The outer edge 2*c* of the upstream alignment shoe 2 is similarly beveled back to make line contact with the edge 14' of the pile 14 on the upper side of the workpiece W as seen in FIG. 13. FIG. 2 also shows how the edge of the alignment shoe 2 has an upstream portion 2*a* that is set out, an angled intermediate portion 2*b*, and a downstream portion 2*c* that is set in so that, as the workpiece W is pulled through, the pile edge 14' will be accurately aligned with the edge 2*c*. In addition as seen in FIG. 1 the upstream end of the shoe 2 is raised to ensure that the workpiece W can feed into it smoothly.

A holddown beam 5 extends from the shoe 2 downstream through the stations A and B and the downstream end of this beam 5 is formed with two extension tongues 10' and 10" that extend through stations C and D as seen in FIG. 16. The beam 5 may in fact be integral with the shoe 2. A sequence of guide blocks 4', 4, and 4" respectively upstream of station A, between stations A and B, and between station B and C are spring loaded to be urged laterally inward toward the edge 14'. The upstream and downstream blocks 4' and 4" are carried on a common bar 11 that is biased against a fixed support 13 by a spring 12 and the middle block 4 is directly biased by its own spring 12 against this support 13 as shown in FIGS. 8 through 10.

Figure 4:
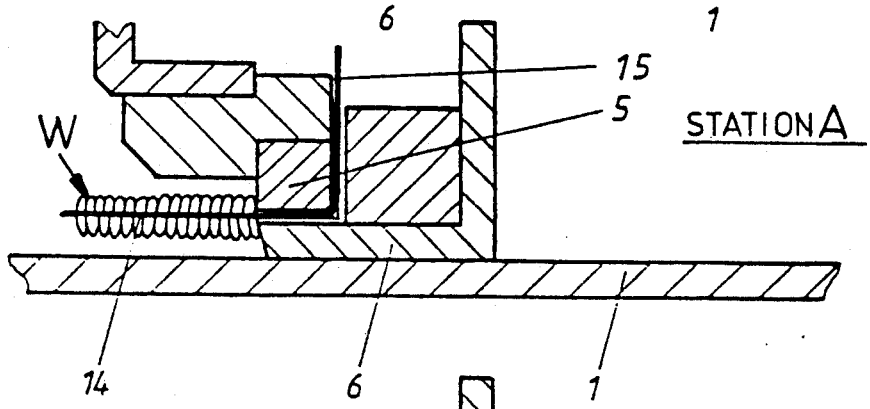
Figure 8:
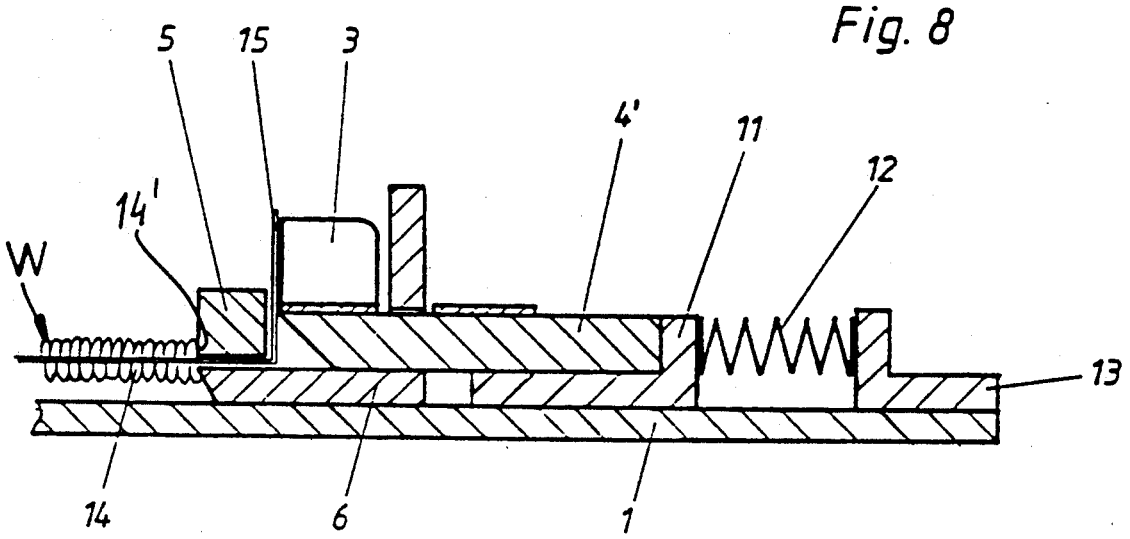
FIGS. 8, 9, and 10 are sections taken along respective lines VIII—VIII, IX—IX, and X—X of FIG. 2.

The upstream most block 4' is formed as shown in FIG. 14 as a wedge shoe pointed upstream and reaching right down to the plane of the upper surface of the bar 6 so that it lifts up the outer two-thirds of the pile-free edge 15 to stand it upright as shown in FIG. 4 in station A and in FIG. 8. A downstream leaf-spring extension 3 of the block 4' maintains the outer two-thirds upright and is in turn connected to and in fact unitary with a lateral deflector 7 that extends at an acute angle to the direction 22 so that the outer third of the pile-free strip 15 is deflected laterally to lie atop the guide beam 5 as can be seen by a comparison of the sequential positions shown in FIGS. 9 and 5. Thus in station B as seen in FIG. 5 the outer strip 15 is C shaped, with the inner and outer thirds extending horizontally and the middle third vertically.

Figure 6:
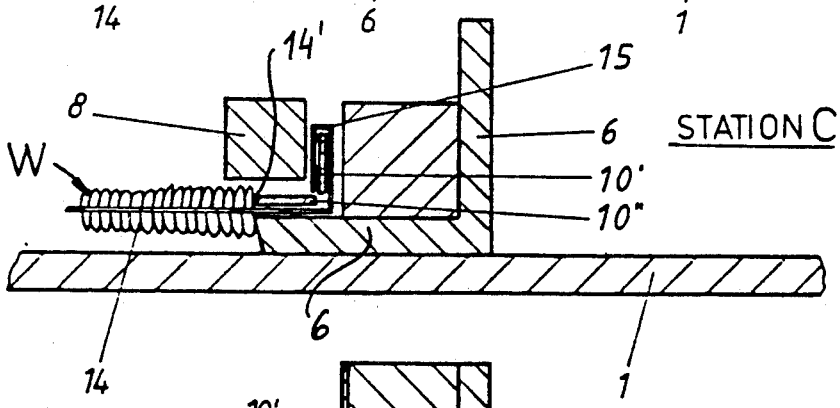

The rearward extension tongues 10' and 10" are oriented with the tongue 10' first forming a continuation of the upright outer face of the beam 5 and the tongue 10" a continuation of the horizontal lower surface of the beam 5. A shaper body 8 starts immediately downstream of the beam 5 as shown in FIG. 10 so that the there unsupported outer third of the strip 15 is folded down over the tongue 10' and this body 8 dips down as shown in FIGS. 6 at station C, to fold the outer two thirds of the strip 15 down over the tongue 10'. Then the tongue 10' itself folds down into a position parallel to but spaced above the tongue 10" so that the strip 15 is double folded to triple thickness and a holddown bar 9 carried on the bar 6 presses down on the bar 6 the sandwich formed by, starting from the top, the outer strip third, the tongue 10', the middle strip third, the tongue 10", and the inner strip third. In this position the strip 15 is stitched vertically together somewhat downstream of the downstream ends of the tongues 10' and 10" to form a very neat and stable selvedge just 7 mm wide. In fact the two tongues 10' and 10" can be unitary with each other in station C and only separated or unitary but of U-section in station D.

Figure 5:
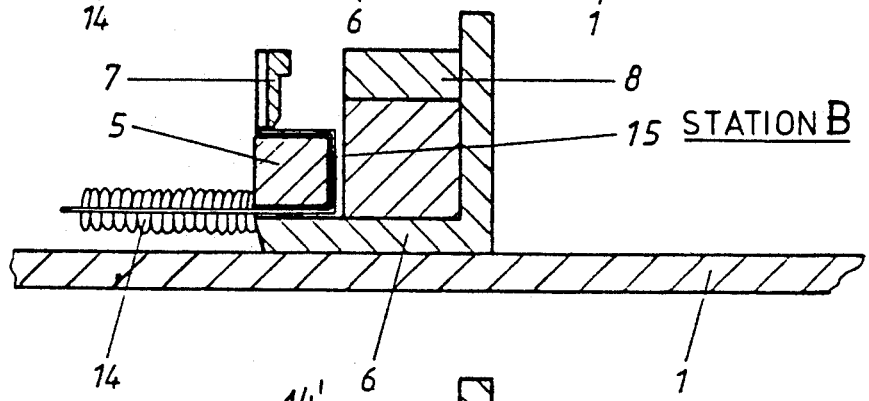
Figure 7:
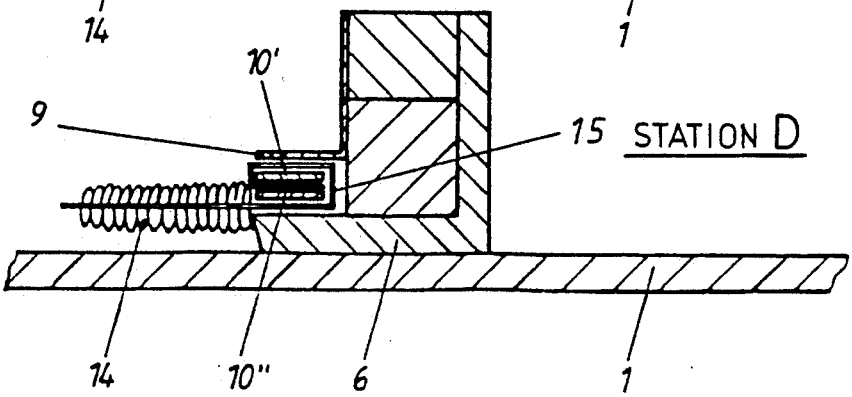

Thus the apparatus of this invention forms a gap which starts out flat (FIG. 3) becomes L-shaped (FIGS. 4, 8, and 9), then becomes C-shaped (FIG. 5). It then reverts as shown in FIG. 10 to L-shaped again (FIG. 6), and becomes finally as seen in FIG. 7 a short horizontal slot.

I claim:

1. An apparatus for selvedging a piece of pile-type textile goods having a central longitudinally extending pile zone and a longitudinal pile-free edge strip of predetermined width, the apparatus comprising:

transport and guide means for moving the goods longitudinally parallel to the edge strip in a transport direction sequentially along a path through first, second, third, and fourth folding stations and then through a stitching station with at least the inner third of the edge strip horizontal, the transport means including a horizontally extending table extending past all the stations and supporting the goods in all of the stations, and a lower guide bar on the table having a straight longitudinally extending edge forming a guide edge extending through the folding stations and along a boundary between the pile-free edge strip and the pile zone for maintaining the positions of the pile-free edge strip and the pile zone in the folding stations;

means in the first folding station including a wedge shoe angling upward from the guide bar to lift the outer two thirds of the edge strip for folding up the outer two-thirds of the edge strip into a vertical position while maintaining the inner third of the edge strip flat and horizontal, whereby the edge strip is basically of L-section;

means in the second folding station for folding the outer third of the edge strip inward to a horizontal position while maintaining the inner third flat and horizontal and the middle third upright so that the edge strip is basically of C-section;

means in the third folding station for folding down the outer third of the edge strip to a vertical position next to and continuous with the middle third in the third station while maintaining the inner third flat and horizontal and the middle third upright;

means in the fourth folding station for folding down the outer and middle thirds of the edge strip to a horizontal position atop the inner third while maintaining the inner third flat and horizontal; and means in the stitching station for sewing vertically through the inner, middle, and outer thirds of the edge strip.

2. The selvedging apparatus defined n claim 1 wherein the means in the second station includes a deflector projecting laterally at an angle from the wedge shoe and engaging the outer third of the edge strip.

3. The selvedging apparatus defined in claim 2 wherein the means in the third and fourth stations includes a pair of holding tongues including a lower tongue extending horizontally above only the inner third of the edge strip and an upper tongue having an upright section in the third station and a horizontal section in the fourth station and engaging the outer two thirds in both stations, the two tongues being superposed and spaced in the fourth station.

4. The selvedging apparatus defined in claim 3 wherein the tongues have widths equal generally to one third of the width of the edge strip.

5. An apparatus for selvedging a piece of pile-type textile goods having a central longitudinally extending pile zone and a longitudinal pile-free edge strip of predetermined width, the apparatus comprising:

transport and guide means for moving the goods longitudinally parallel to the edge strip in a transport direction sequentially along a path through first, second, third, and fourth folding stations and then through a stitching station with at least the inner third of the edge strip horizontal, the guide and transport means including a horizontally extending table extending past all the stations and supporting the goods in all of the stations, a lower guide bar on the table having a straight longitudinally extending edge forming a guide edge extending through the folding stations and along a boundary between the pile-free edge strip and the pile zone for maintaining the positions of the pile-free edge strip and the pile zoom in the folding stations, and a plurality of longitudinally spaced guide blocks engaging the pile-free edge zone between the first and fourth folding stations and spring means urging the blocks toward the pile zone;

means in the first folding station for folding up the outer two-thirds of the edge strip into a vertical position while maintaining the inner third of the edge strip flat and horizontal, whereby the edge strip is basically of L-section;

means in the second folding station for folding the outer third of the edge strip inward to a horizontal position while maintaining the inner third flat and horizontal and the middle third upright so that the edge strip is basically of C-section;

means in the third folding station for folding down the outer third of the edge strip to a vertical position next to and continuous with the middle third in the third station while maintaining the inner third flat and horizontal and the middle third upright;

means in the fourth folding station for folding down the outer and middle thirds of the edge strip to a horizontal position atop the inner third while maintaining the inner third flat and horizontal; and means in the stitching station for sewing vertically through the inner, middle, and outer thirds of the edge strip.

* * * * *